US009207560B2

(12) United States Patent
Abe et al.

(10) Patent No.: US 9,207,560 B2
(45) Date of Patent: Dec. 8, 2015

(54) LASER LIGHT CONTROL DEVICE AND IMAGE FORMING APPARATUS

(71) Applicant: KYOCERA Document Solutions Inc., Osaka (JP)

(72) Inventors: Hiroshi Abe, Osaka (JP); Masayuki Sago, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/193,432

(22) Filed: Feb. 28, 2014

(65) Prior Publication Data

US 2014/0240439 A1 Aug. 28, 2014

(30) Foreign Application Priority Data

Feb. 28, 2013 (JP) ..... 2013-040158

(51) Int. Cl.
*G03G 15/043* (2006.01)
*G03G 15/04* (2006.01)

(52) U.S. Cl.
CPC ..... *G03G 15/043* (2013.01); *G03G 15/04072* (2013.01)

(58) Field of Classification Search
CPC ..... G03G 15/04072; G03G 15/043; G01R 23/005; B41J 2/447
USPC ..... 347/246
See application file for complete search history.

(56) References Cited

U.S. PATENT DOCUMENTS

| | | | | |
|---|---|---|---|---|
| 4,888,647 | A | 12/1989 | Wada | |
| 6,151,056 | A * | 11/2000 | Araki | 347/246 |
| 2009/0185242 | A1 * | 7/2009 | Komai | 358/474 |

FOREIGN PATENT DOCUMENTS

| | | | |
|---|---|---|---|
| JP | H01-164915 | A | 6/1989 |
| JP | H04-331911 | | 11/1992 |
| JP | 06245140 | A * | 9/1994 |
| JP | H 11-133324 | | 5/1999 |
| JP | 2008-009025 | A | 1/2008 |
| JP | 2008009025 | A * | 1/2008 |
| JP | 2011-081233 | A | 4/2011 |

OTHER PUBLICATIONS

Notice of Rejection mailed by Japan Patent Office on Apr. 21, 2015 in the corresponding Japanese patent application No. 2013-040158—3 pages.

* cited by examiner

*Primary Examiner* — Sarah Al Hashimi
(74) *Attorney, Agent, or Firm* — Knobbe, Martens, Olson & Bear LLP

(57) ABSTRACT

A laser light control device includes: a photodiode disposed, along with a semiconductor laser, at a location capable of receiving laser light reflected on a polygon mirror after emitted from the semiconductor laser can be received; a semiconductor laser drive control section; and a comparison circuit configured to compare an output voltage of the photodiode and a reference voltage corresponding to a reference amount of light of the semiconductor laser. The semiconductor laser drive control section uses a timing with which the semiconductor laser drive control section receives from the comparison circuit an output indicating that the voltage output from the photodiode is larger than the reference voltage to generate a light emission start timing with which the semiconductor laser starts to emit laser light based on an image signal.

4 Claims, 7 Drawing Sheets

LASER LIGHT CONTROL DEVICE AND IMAGE FORMING APPARATUS

INCORPORATION BY REFERENCE

This application claims priority to Japanese Patent Application No. 2013-040158 filed on Feb. 28, 2013, the entire contents of which are incorporated by reference herein.

BACKGROUND

The present disclosure relates to laser light control devices and image forming apparatuses and particularly relates to a technique for generating a light emission start timing with which emission of laser light based on an image signal is started.

An image forming apparatus includes, as an exposure section, a laser scanning unit configured to irradiate the surface of a photosensitive drum with laser light emitted from a light-emitting part, such as a laser diode, to form an electrostatic latent image. The laser scanning unit includes a BD sensor equipped with, for example, a PIN photodiode, in order to synchronize a reflecting surface of a polygon mirror (rotating polyhedron) with the timing of emission of laser light from the light-emitting part. The BD sensor provided in the laser scanning unit is at a different location from the light-emitting part and the laser scanning unit is configured to generate a BD signal (timing signal) at the time when the BD sensor receives light reflected on the polygon mirror after emitted from the light-emitting part and use the BD signal to generate a light emission start timing with which the light-emitting part starts to emit laser light based on an image signal.

SUMMARY

A laser light control device according to one aspect of the present disclosure includes a light-emitting part, a light-receiving part, a light emission control section, and a comparison circuit.

The light-emitting part is configured to emit laser light based on an image signal toward a rotating polyhedron having a plurality of reflecting surfaces for use in allowing the laser light to scan across a surface of the photosensitive drum.

The light-receiving part is disposed, along with the light-emitting part, at a location capable of receiving the laser light reflected from the rotating polyhedron and configured to receive the light emitted from the light-emitting part and the reflected light.

The light emission control section is configured to control driving of the light-emitting part and take control to maintain a reference amount of light of the light-emitting part at a constant amount according to a voltage output from the light-receiving part depending upon an amount of light received by the light-receiving part.

The comparison circuit is configured to compare the voltage output from the light-receiving part with a reference voltage corresponding to the reference amount of light of the light-emitting part.

Furthermore, the light emission control section uses a timing with which the light emission control section receives from the comparison circuit an output indicating that the voltage output from the light-receiving part is larger than the reference voltage to generate a light emission start timing with which the light-emitting part starts to emit the laser light based on the image signal.

An image forming apparatus according to another aspect of the present disclosure includes the above-mentioned laser light control device and an image forming section.

The image forming section is configured to generate a toner image using an electrostatic latent image formed on the surface of the photosensitive drum by the laser light emitted from the laser light control device and transfer the toner image directly or indirectly to a recording medium to form an image.

DETAILED DESCRIPTION

Figure 1:
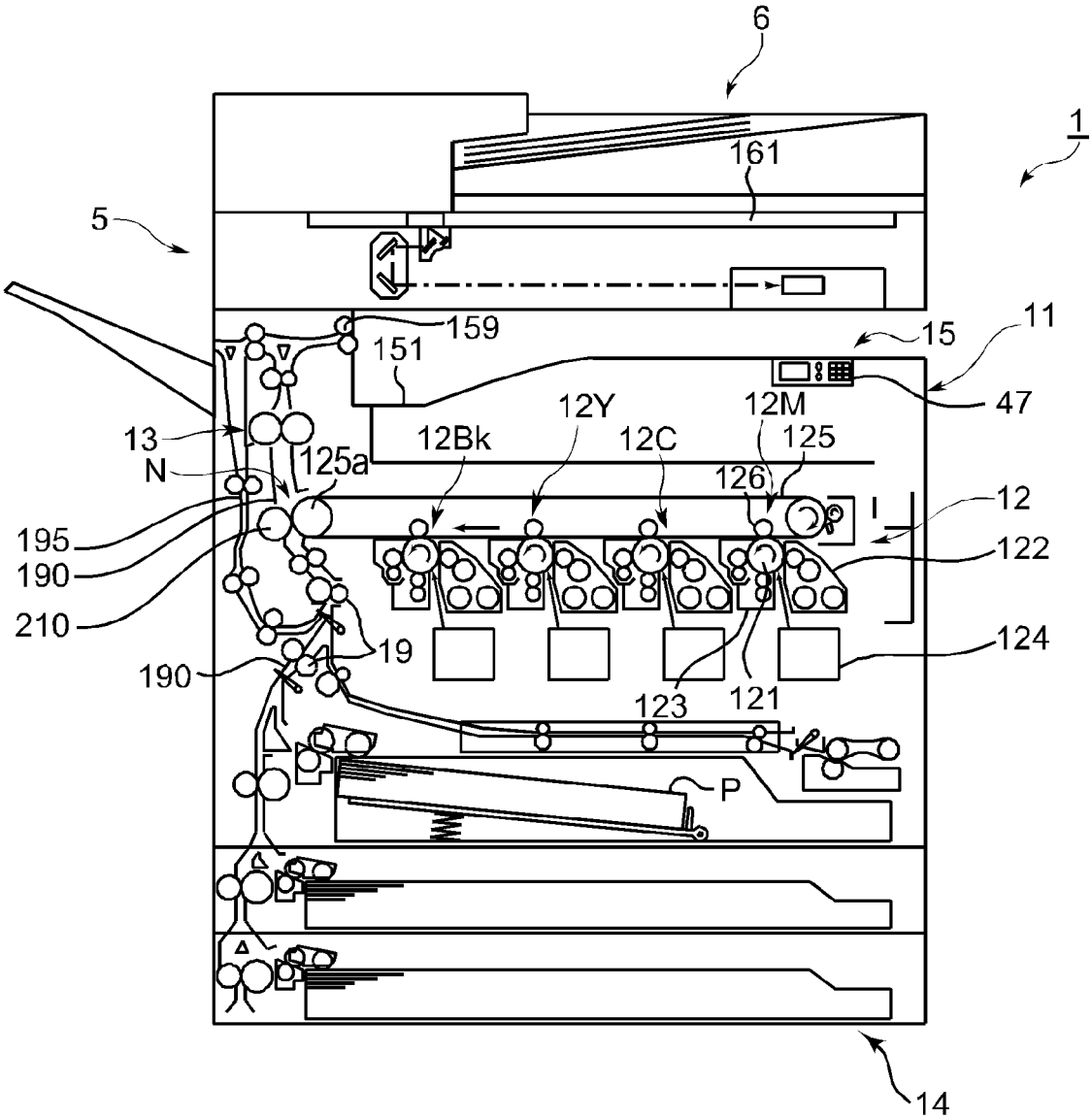
FIG. 1 is a front cross-sectional view showing the structure of an image forming apparatus according to one embodiment of the present disclosure.

Hereinafter, a description will be given of a laser light control device and an image forming apparatus according to one embodiment of the present disclosure with reference to the drawings. FIG. 1 is a front cross-sectional view showing the structure of the image forming apparatus 1 according to the one embodiment of the present disclosure.

The image forming apparatus 1 according to the one embodiment of the present disclosure is a multifunction peripheral having multiple functions including, for example, a copy function, a print function, a scan function, and a facsimile function. The image forming apparatus 1 is made up so that an apparatus body 11 thereof includes an operating section 47, an image forming section 12, a fixing section 13, a paper feed section 14, a document feed section 6, an image reading section 5, and so on.

The operating section 47 is configured to receive operator's commands for various types of operations and processing executable by the image forming apparatus 1, such as a command to execute an image forming operation and a command to execute a document reading operation.

In a document reading operation of the image forming apparatus 1, the image reading section 5 optically reads an image of an original document being fed from the document feed section 6 or an image of an original document placed on an original glass plate 161 to generate image data. The image data generated by the image reading section 5 is stored on an internal HDD, a network-connected computer or the like.

In an image forming operation of the image forming apparatus 1, the image forming section 12 forms a toner image on a recording paper sheet P serving as a recording medium fed from the paper feed section 14, based on image data generated by the document reading operation, image data received from a network-connected computer or image data stored on the internal HDD. Each of image forming units 12M, 12C, 12Y, and 12Bk of the image forming section 12 includes a photosensitive drum 121, a developing device 122 operable to supply toner to the photosensitive drum 121, a toner cartridge (not shown) for holding toner, a charging device 123, an exposure device 124, and a primary transfer roller 126. The exposure device 124 includes a laser light control device (to be described later) according to one embodiment of the present disclosure.

In the case of color printing, an image forming unit 12M for magenta, an image forming unit 12C for cyan, an image forming unit 12Y for yellow, and an image forming unit 12Bk for black of the image forming section 12 form respective toner images on their respective photosensitive drums 121 through charging, exposure, and developing processes based on respective images of respective different color components constituting the above image data and then allow their respective primary transfer rollers 126 to transfer the toner images to an intermediate transfer belt 125.

The toner images of different colors transferred to the intermediate transfer belt 125 are superposed each other on the intermediate transfer belt 125 by controlling their transfer timings, resulting in a multicolor toner image. A secondary transfer roller 210 transfers the multicolor toner image formed on the surface of the intermediate transfer belt 125, at a nip N between the secondary transfer roller 210 and a drive roller 125*a* with the intermediate transfer belt 125 in between, to a recording paper sheet P conveyed from the paper feed section 14 along a conveyance path 190. Thereafter, the fixing section 13 fixes the toner image on the recording paper sheet P by the application of heat and pressure. The recording paper sheet P on which a multicolor image has been fixed by the completion of the fixing treatment is discharged to a paper output tray 151.

In the case of double-sided printing of the image forming apparatus 1, the recording paper sheet P having an image already printed on one side by the image forming section 12 is nipped by an output roller pair 159, then moved back and conveyed to a reverse conveyance path 195 by the output roller pair 159, and conveyed again upstream of the nip N and the fixing section 13 in a direction of conveyance of the recording paper sheet P by a conveyance roller pair 19. Thus, an image is formed on the other side of the recording paper sheet P by the image forming section 12.

Figure 2:
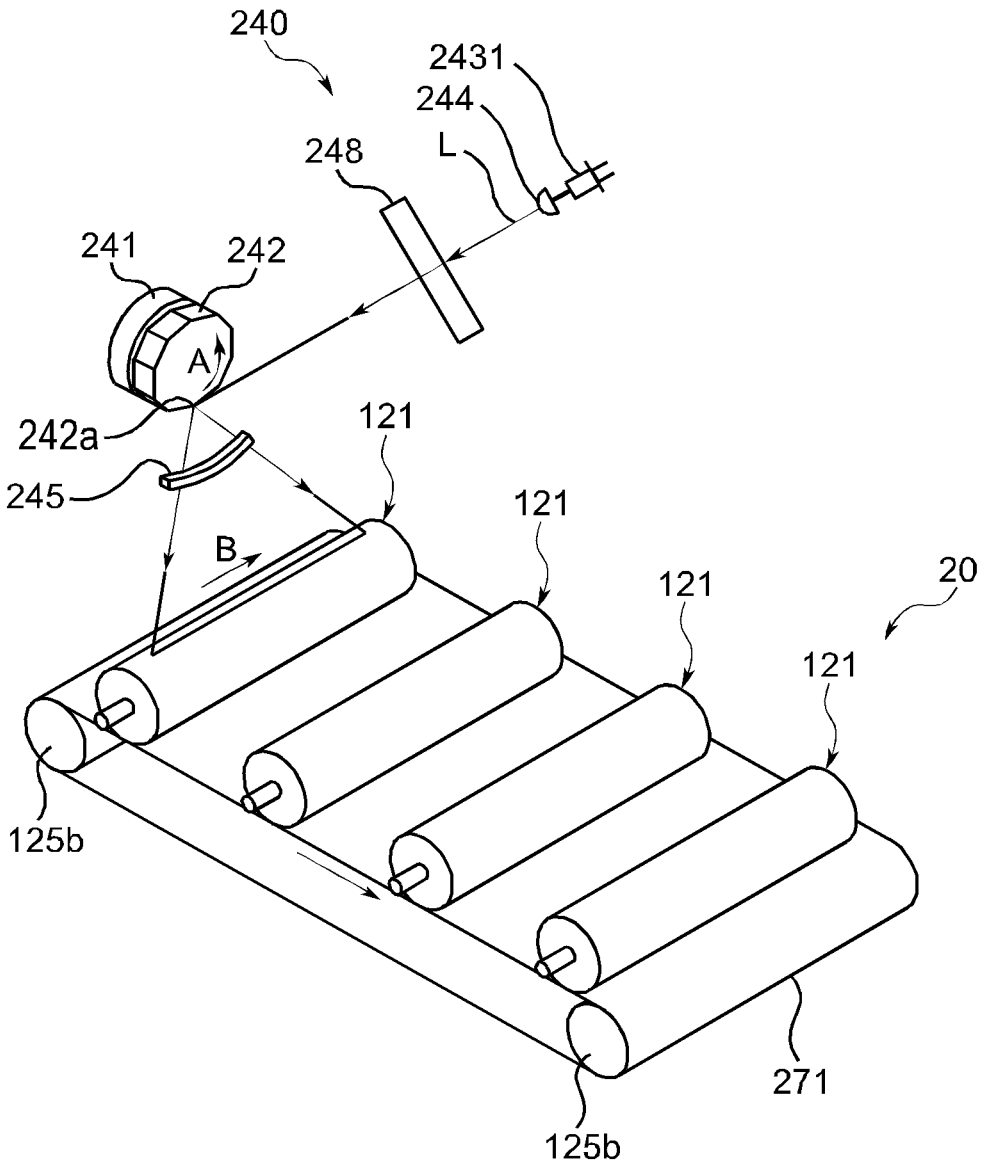
FIG. 2 is a perspective view illustrating laser beam scanning of an exposure device in the one embodiment of the present disclosure shown in FIG. 1.

FIG. 2 is a perspective view illustrating laser beam scanning of the exposure device 124 shown in FIG. 1. Hereinafter, the exposure device 124 will be described with reference to as a laser scanning unit 240. The image forming units 12M, 12C, 12Y, 12Bk include their respective laser scanning units 240 having the same structure.

The laser scanning unit 240 is a laser beam scanning mechanism configured to use laser light to scan along a scanning line extending in a main scanning direction. The laser scanning unit 240 includes a polygon motor 241, a polygon mirror 242, a semiconductor laser 2431, a collimator lens 244, an fθ lens 245, and a cylindrical lens 248.

The polygon mirror (rotating polyhedron) 242 has a plurality of reflecting surfaces each formed of a mirror surface and is configured to reflect laser light on each reflecting surface toward the surface of the photosensitive drum 121. The polygon motor 241 is operable to supply to the polygon mirror 242 a drive force for rotating the polygon mirror 242 in the direction of the arrow A in FIG. 2.

Figure 3:
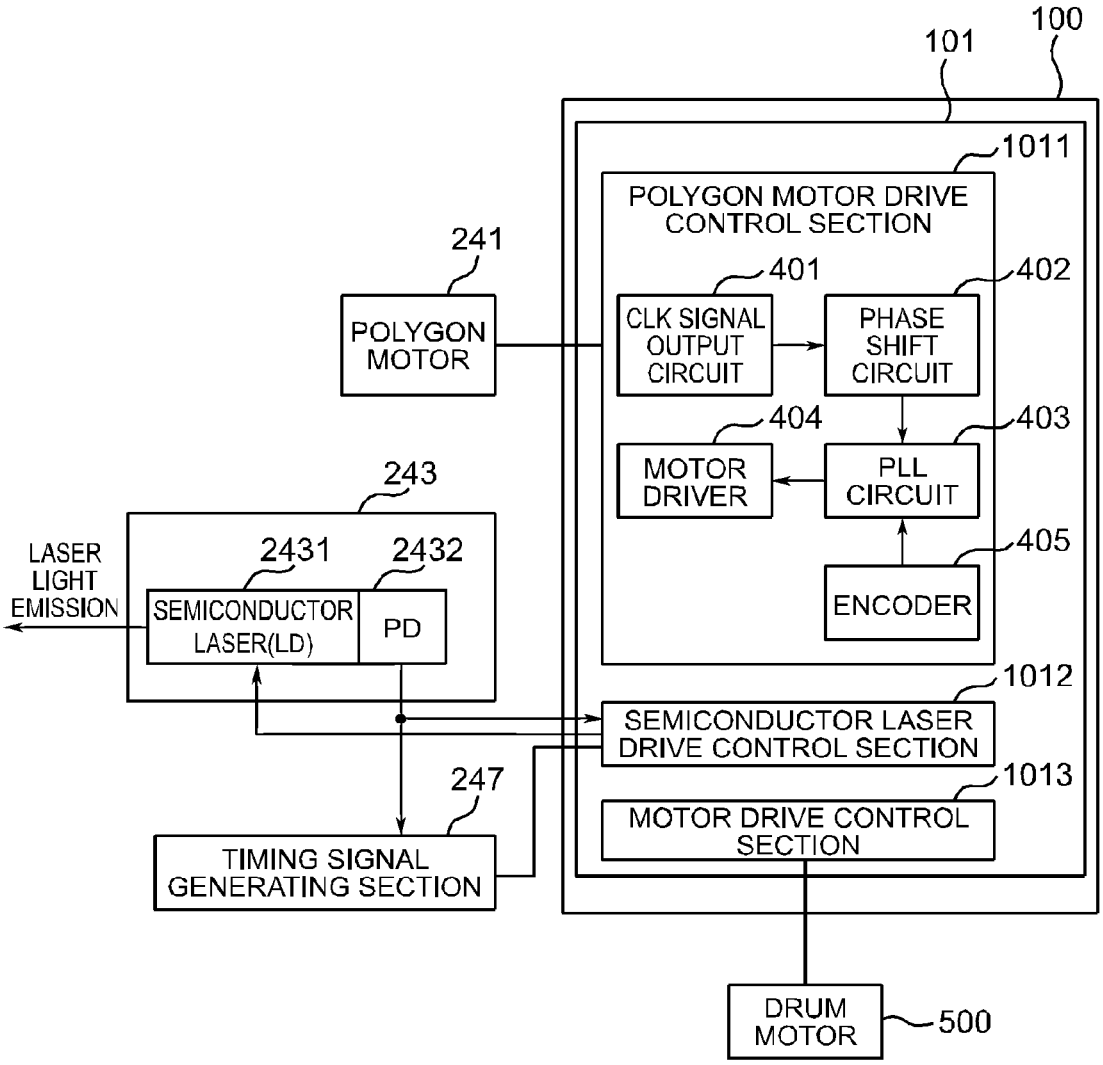
FIG. 3 is a block diagram showing a schematic architecture of a control system of the image forming apparatus according to the one embodiment of the present disclosure.

The semiconductor laser (light-emitting part) 2431 is a device capable of emitting laser light and the laser light can be modulated according to an input image signal by a semiconductor laser drive control section 1012 (see FIG. 3). The semiconductor laser 2431 is provided inside a laser light source 243 (see FIG. 3) to be described later. The collimator lens 244 allows passage of a light beam L emitted from the semiconductor laser 2431 to change the beam L into a collimated light beam.

Thereafter, the beam L emitted from the semiconductor laser 2431 passes through the cylindrical lens 248 and then forms a line image on each reflecting surface 242*a* of the polygon mirror 242. The polygon mirror 242 is configured to rotate at a constant speed in the direction of the arrow A in FIG. 2, whereby the beam L deflected by each reflecting surface 242*a* enters the fθ lens 245 while moving in the direction of the arrow B in FIG. 2.

The fθ lens 245 is configured to allow laser light deflected by the polygon mirror 242 to horizontally scan across the surface of the photosensitive drum 121 in an axial direction of the photosensitive drum 121 at a constant speed. The beam L having passed through the fθ lens 245 is focused as a beam spot on the surface of the photosensitive drum 121 and optically scans across the surface (scanned surface) of the photosensitive drum 121 in the main scanning direction with the rotation of the polygon mirror 242 and the photosensitive drum 121, so that an image according to the image signal is recorded on the surface of the photosensitive drum 121.

Figure 4:
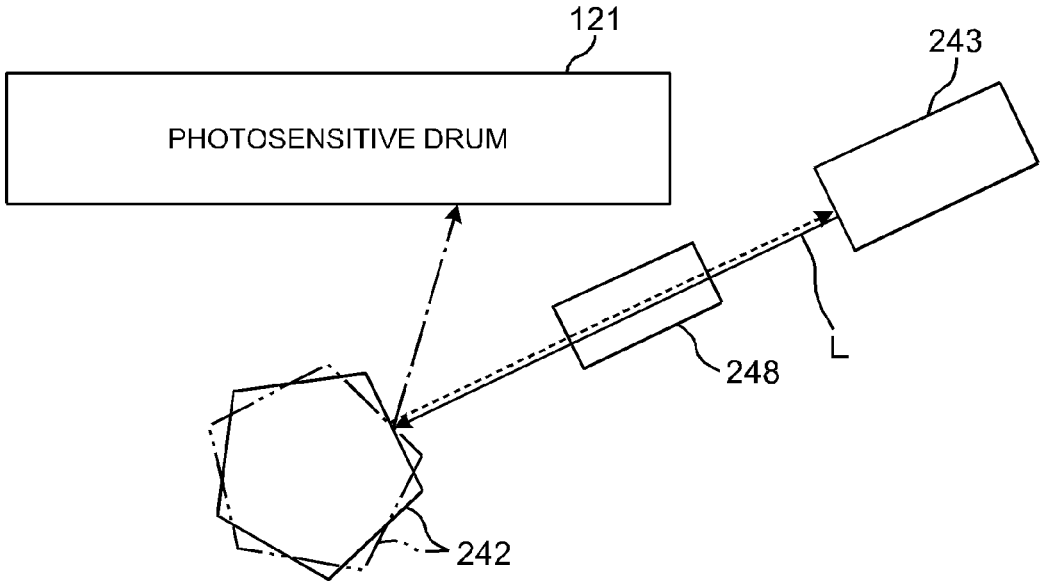
FIG. 4 is an illustration showing a relationship between a polygon motor and a timing signal generating section in the one embodiment of the present disclosure.

Next, a description will be given of the configuration of a control system of the image forming apparatus 1. FIG. 3 is a block diagram showing a schematic architecture of the control system of the image forming apparatus 1. FIG. 4 is an illustration showing a relationship between the polygon motor 241 and a timing signal generating section 247. The following description will be given mainly of the configuration relating to the present disclosure.

The image forming apparatus 1 includes a control unit 100. The control unit 100 provides overall control of the operation of the image forming apparatus 1. The control unit 100 includes an image formation control section 101.

The image formation control section 101 provides control of driving of each of operative mechanisms operating during image formation. For example, the image formation control section 101 takes control of driving of each of the image forming units 12M, 12C, 12Y, and 12Bk. The image formation control section 101 includes, for the laser scanning units 40, a polygon motor drive control section 1011 and a semiconductor laser drive control section 1012 and includes, for the photosensitive drums 121, a motor drive control section 1013.

The polygon motor drive control section 1011 is configured to, based on a clock signal (hereinafter referred to as a "CLK signal") output from a clock signal output circuit (hereinafter referred to as a "CLK signal output circuit") 401, drive the polygon motor 241 to rotate at a predetermined desired rotational speed. The polygon motor drive control section 1011 includes the CLK signal output circuit 401, a phase shift circuit 402, a pulse-locked loop (PLL) circuit 403, a motor driver 404, and an encoder 405.

The following is a description of the control of the polygon motor drive control section 1011 over the number of revolutions of the polygon motor 241. Upon receipt of, for example, an operator's request to start image formation, the polygon motor drive control section 1011 allows the PLL circuit 403 to input through the phase shift circuit 402 a CLK signal output with a predetermined frequency from the CLK signal output circuit 401. The PLL circuit 403 compares the frequency of the input CLK signal with the frequency of rotation of the polygon motor 241 output by the encoder 405 attached to the polygon motor 241 and outputs a phase difference between both the frequencies to the motor driver 404. The motor driver 404 supplies to the polygon motor 241*a* drive current modulated to eliminate the phase difference. Thus, the polygon motor 241 is driven into rotation according to the drive current to converge its rotational speed (number of revolutions per unit time) on the desired rotational speed.

The semiconductor laser drive control section (light emission control section) 1012 is a driver operable to drive the semiconductor laser 2431. When the number of revolutions of the polygon motor 241 is converged on the desired number of revolutions, the semiconductor laser drive control section 1012 reads data to be used for image formation, such as image data having been read by the image forming section 5 and stored in an unshown memory, by several lines into a built-in buffer and drives the semiconductor laser 2431 to emit a beam of light modulated based on an image signal indicated by the image data.

For example, the semiconductor laser drive control section 1012 contains: a bias current generating circuit configured to generate a bias current to allow the semiconductor laser 2431 to emit light at a reference amount of light (a predetermined constant amount of light); and an exposure current generating circuit configured to generate an exposure current according to the image signal indicated by the image data. The bias current is a current which causes the semiconductor laser 2431 to emit light at a predetermined reference amount of light.

The semiconductor laser drive control section 1012 is configured to superimpose the exposure current modulated according to the image signal on the bias drive current and use the superimposed current as a drive current of the semiconductor laser 2431 for exposure during image formation to turn the semiconductor laser 2431 on and off at high speed, thereby exposing the surface of the photosensitive drum 121 to light (writing an image thereon) line by line in the main scanning direction based on the image signal.

The laser light source 243 includes the semiconductor laser (LD) 2431 and a photodiode (PD) 2432. The photodiode (light-receiving part) 2432 is disposed, for example, on a back side of the semiconductor laser 2431 opposite to the surface thereof from which laser light is to be emitted. The photodiode 2432 receives leakage (leaked light) of laser light emitted by the semiconductor laser 2431. The amount of leaked light varies in proportion to the amount of laser light emitted by the semiconductor laser 2431. The photodiode 2432 outputs and feeds back a voltage depending upon the amount of leaked light received to the semiconductor laser drive control section 1012. The semiconductor laser drive control section 1012 acquires the output voltage from the photodiode 2432 and changes the bias current to bring the output voltage to a reference voltage (an output voltage when the photodiode 2432 receives the reference amount of light), thereby taking control to maintain the emission of light of the semiconductor laser 2431 at the constant reference amount of light.

Furthermore, as shown in FIG. 4, the laser light source 243 is disposed opposite the reflecting surface of the polygon mirror 242. The laser light source 243 is configured so that when the orientation of each reflecting surface of the rotating polygon mirror 242 coincides with the orientation perpendicular to the laser light (beam L) emitted by the semiconductor laser 2431 (i.e., the orientation indicated by the solid line in FIG. 4), reflected light of the laser light, for example, light specularly reflected on the surface of the polygon mirror 242, is received by the photodiode 2432. To sum up, the photodiode 2432 receives not only the leaked light of the semiconductor laser 2431 but also the reflected light from the reflecting surface of the polygon mirror 242 depending upon the timing of incidence of the reflected light.

The timing signal generating section 247 is configured to generate a pulse wave as a synchronizing signal (BD signal) and output it to the semiconductor laser drive control section 1012. The synchronizing signal output from the timing signal generating section 247 is used to synchronize the rotation of the polygon mirror 242 with the timing of image writing of the semiconductor laser 2431. The photodiode 2432 outputs the output voltage depending upon the amount of light received not only to the semiconductor laser drive control section 1012 but also to the timing signal generating section 247.

The motor drive control section 1013 controls rotary drive of a drum motor 500 to bring the rotational speed of the drum motor 500 to a predetermined standard speed and controls rotary drive of an unshown motor as a drive source for the drive roller 125*a* of the intermediate transfer belt 125 to bring the traveling speed of the intermediate transfer belt 125 to the same speed as the circumferential speed of the photosensitive drum 121.

Before the image forming units 12M, 12C, 12Y, and 12Bk start to write image data using their respective semiconductor lasers 2431, the control unit 100 synchronizes the timings of writing of image data among the image forming units 12M, 12C, 12Y, and 12Bk (in other words, the control unit 100 allows the image forming units 12M, 12C, 12Y, and 12Bk to write image data, using their respective semiconductor lasers 2431, for each scanning line in the main scanning direction with the writing timings kept at predetermined certain time intervals). Thus, different colored toner images formed on the intermediate transfer belt 125 are superimposed on each other without misalignment to avoid the occurrence of any color registration error in the generated multicolor toner image.

The laser light control device according to the one embodiment of the present disclosure is a device including the semiconductor laser 2431, the photodiode 2432, the semiconductor laser drive control section 1012, and the timing signal generating section 247.

Figure 5:
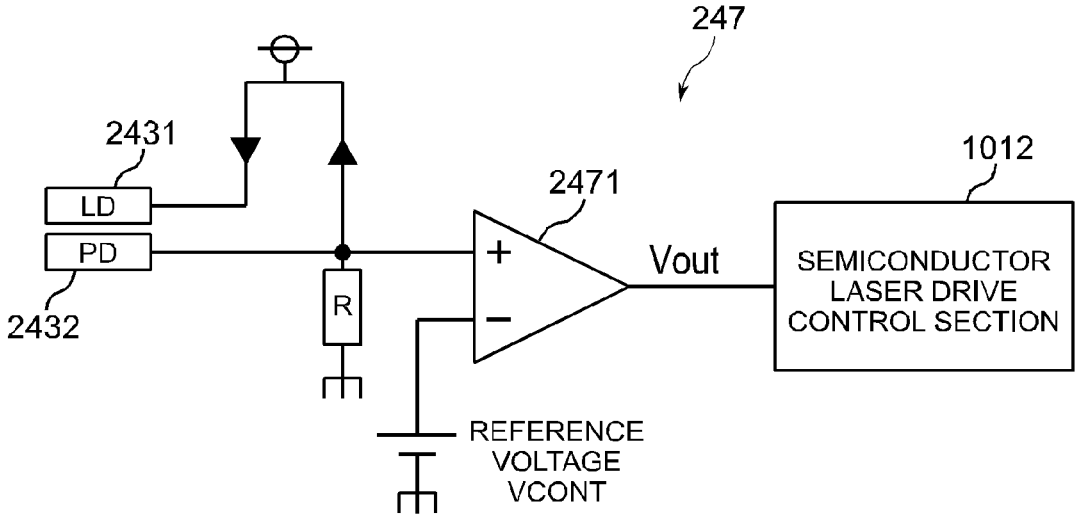
FIG. 5 is a diagram showing an internal structure of the timing signal generating section in the one embodiment of the present disclosure.
Figure 6:
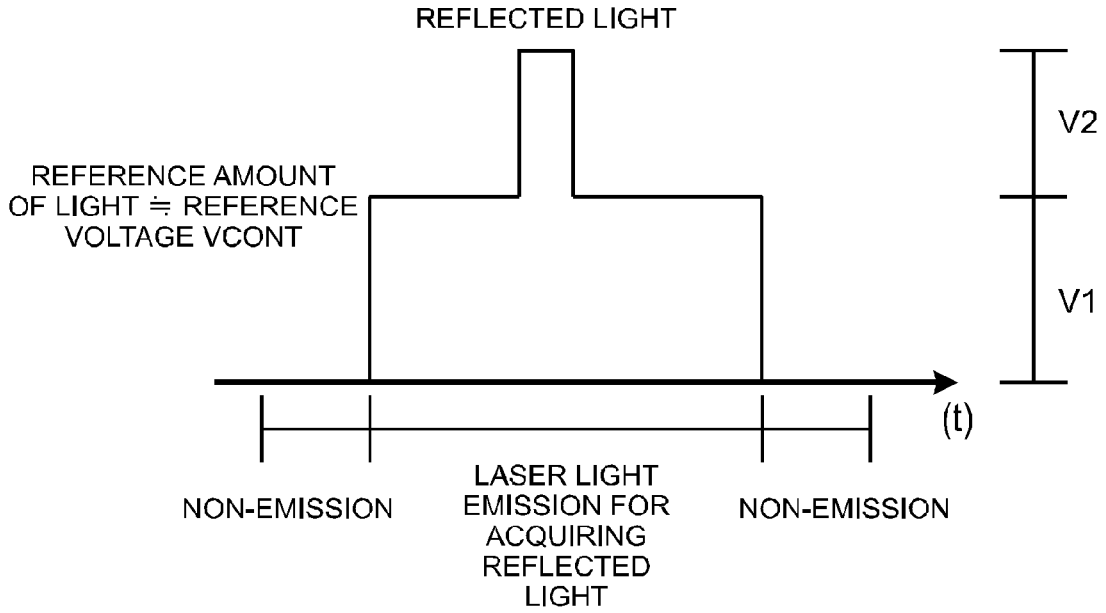
FIG. 6 is a chart showing the waveform of an output voltage of a photodiode when light reflected from a polygon mirror enters the photodiode in the one embodiment of the present disclosure.

Next, a description will be given of the structure of the timing signal generating section 247. FIG. 5 is a diagram showing an internal structure of the timing signal generating section 247. FIG. 6 is a chart showing the waveform of an output voltage of the photodiode 2432 when light reflected from the polygon mirror 242 enters the photodiode 2432.

The timing signal generating section 247 includes a comparison circuit 2471. Input to the positive terminal (plus side) of the comparison circuit 2471 is an output voltage output by the photodiode 2432 according to the amount of light received. Input to the negative terminal (minus side) of the comparison circuit 2471 is the reference voltage, i.e., a voltage (VCONT) equal to the output voltage of the photodiode 2432 when receiving the reference amount of light from the semiconductor laser 2431. As described previously, the photodiode 2432 receives the leaked light from the semiconductor laser 2431 and the reflected light from the polygon mirror 242.

Also, as described previously, when the orientation of each reflecting surface of the rotating polygon mirror 242 coincides with the orientation perpendicular to the laser light emitted by the semiconductor laser 2431, the laser light specularly reflected on the surface of the polygon mirror 242 is received by the photodiode 2432. Therefore, at this time, the photodiode 2432 receives light in which the reflected light is superimposed on the leaked light. Thus, as shown in FIG. 6, when the photodiode 2432 receives the reflected light, the output voltage of the photodiode 2432 shows a waveform in which a pulse component of a voltage V2 corresponding to the amount of the reflected light is added to a voltage V1 indicating the amount of light upon receipt of the leaked light. Based on this, when the pulse component is added while the reference voltage VCONT is input to the negative terminal of the comparison circuit 2471, the comparison circuit 2471 outputs a High signal as an output voltage Vout. The High signal is input to the semiconductor laser drive control section 1012. Thus, the timing when the photodiode 2432 has received the reflected light can be extracted.

When receiving the High signal in this manner, the semiconductor laser drive control section 1012 uses the High signal as a BD signal. This High signal is output when each reflecting surface of the polygon mirror 242 has moved by rotation to a predetermined position (the position perpendicular to the laser light of the semiconductor laser 2431). Therefore, by generating, based on the High signal, a laser light emission start timing with which the semiconductor laser 2431 starts to emit laser light based on the image signal, the position of the relevant reflecting surface of the polygon mirror 242 can be synchronized with the laser light emission start timing with which the semiconductor laser 2431 starts to emit laser light based on the image signal.

As thus far described, in the laser light control device according to this embodiment, the laser light source 243 is disposed at a location opposite the reflecting surface of the polygon mirror 242 and capable of receiving the reflected light and the results of comparison between the output voltage from the photodiode 2432 and the reference voltage are input from the timing signal generating section 247 to the semiconductor laser drive control section 1012. Thus, a laser light emission start timing with which the semiconductor laser 2431 starts to emit laser light based on the image signal can be generated and there is no need for any PIN photodiode and any peripheral circuit thereof, such as an amplifier circuit, which would be required in the case of generating a BD signal using a BD sensor, and no need for any dedicated device produced as a photo IC.

If the rotation and phase of the polygon motor for use in rotating the polygon mirror are monitored, a BD signal can be generated without the need for the PIN photodiode and its peripheral circuits, such as an amplifier circuit. However, in this case, the accuracy of position or the like of each reflecting surface of the polygon mirror is out of consideration and the generated timing is therefore nothing but an estimation and has a problem with accuracy. Unlike this, in the laser light control device according to this embodiment, since a BD signal is generated based on the position of the reflecting surface of the polygon mirror 242 at the time when the semiconductor laser 2431 emits laser light, the generated BD signal can correctly reflect the positional accuracy of the reflecting surface of the polygon mirror 242.

Figure 7:
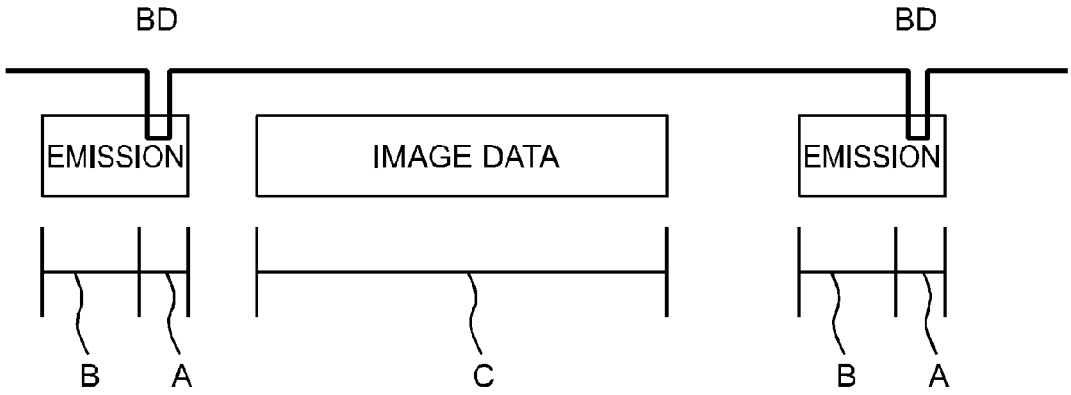
FIG. 7 is a timing chart showing a relationship between the period of emission of laser light of a semiconductor laser and the timing with which a BD signal is acquired in the one embodiment of the present disclosure.

Next, a description will be given of the control of emission of laser light of the semiconductor laser 2431 for the purpose of acquiring the reflected light from the polygon mirror 242. FIG. 7 is a timing chart showing a relationship between the period of emission of laser light of the semiconductor laser 2431 and the timing with which a BD signal is acquired.

The semiconductor laser drive control section 1012 turns the semiconductor laser 2431 on in the following three periods: (1) a period A of emission of laser light for acquiring a BD signal; (2) a period B of emission of laser light for the control for maintaining the emission of laser light of the semiconductor laser 2431 at the reference amount of light; and (3) a period C of emission of laser light for exposure based on the image signal.

As shown in FIG. 7, the semiconductor laser drive control section 1012 sets, as a period of emission of laser light of the semiconductor laser 2431 for acquiring a BD signal, the period A around the timing with which the reflecting surface of the polygon mirror 242 is supposed to be perpendicular to the laser light from the semiconductor laser 2431.

For example, in a structure in which a BD sensor is separately provided to generate a BD signal, there arises a problem in that when during the control for maintaining the emission of laser light of the semiconductor laser 2431 at the reference amount of light the photodiode 2432 receives reflected light from the polygon mirror 242 and a pulse component of voltage corresponding to the amount of the reflected light is added to the output voltage of the photodiode 2432, the bias current generated does not reach the value corresponding to the reference amount of light, so that the amount of light emitted from the semiconductor laser 2431 cannot be maintained at the reference amount of light. Therefore, in this structure, the semiconductor laser 2431 is controlled to be turned on out of the timing with which the photodiode 2432 receives reflected light from the polygon mirror 242 and maintain light emission at the reference amount of light.

Unlike this, in this embodiment, in order to acquire a BD signal, it is necessary to turn the semiconductor laser 2431 on with the timing with which the photodiode 2432 receives the reflected light from the polygon mirror 242. For this reason, in this embodiment, although the semiconductor laser drive control section 1012 allows the semiconductor laser 2431 to emit laser light to acquire a BD signal for the period A, the period B for the control for maintaining the emission of semiconductor laser 2431 at the reference amount of light is set to avoid the period A as shown in FIG. 7 in consideration of the above problem.

Furthermore, the semiconductor laser drive control section 1012 sets a certain time zone other than the periods A and B to the period C for which the semiconductor laser 2431 emits laser light based on the image signal. Thus, while the position of the relevant reflecting surface of the polygon mirror 242 can be synchronized with the light emission start timing with which the semiconductor laser 2431 starts to emit laser light based on the image signal and the amount of laser light emitted from the semiconductor laser 2431 can be adjusted to maintain the reference amount of light, the surface of the photosensitive drum 121 can be exposed according to the image signal.

The present disclosure is not limited to the above embodiment and can be modified in various ways. For example, although the description of the above embodiment is given taking a multifunction peripheral as an example of the image forming apparatus according to the present disclosure, the example is merely illustrative and the image forming apparatus may be any other image forming apparatus, such as a printer, a copier or a facsimile machine.

The structure and processing shown in the above embodiment with reference to FIGS. 1 to 7 are merely illustrative of the present disclosure and not intended to limit the present disclosure to the above particular structure and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A laser light control device comprising:

a light-emitting part configured to emit laser light based on an image signal toward a rotating polyhedron having a plurality of reflecting surfaces for use in allowing the laser light to scan across a surface of the photosensitive drum;

a light-receiving part disposed, along with the light-emitting part, at a location capable of receiving the laser light reflected from the rotating polyhedron and configured to receive the light emitted from the light-emitting part and the reflected light;

a comparison circuit configured to compare the voltage output from the light-receiving part with a reference voltage equal to an output voltage of the light-receiving part in which the light receiving part receives a reference amount of light from the light-emitting part, and output an output signal when the voltage output from the light-receiving part is larger than the reference voltage, and a light emission control section configured to control driving of the light-emitting part and perform a control (i) to maintain the reference amount of light of the light-emitting part at a constant amount and a control (ii) to generate a light emission start timing with which the light-emitting part starts to emit the laser light based on the image signal, both the controls using a single voltage output from the light-receiving part depending upon an amount of light received by the light-receiving part, wherein in the control (i) the reference amount of light of the light-emitting part is maintained at the constant amount by feedback control based on the voltage output from the light-receiving part and in the control (ii) a timing with which the output signal output from the comparison circuit is received is the light emission start timing with which the light-emitting part starts to emit the laser light based on the image signal.

2. The laser light control device according to claim 1, wherein the light-receiving part is disposed on a back side of the light-emitting part opposite to the surface thereof from which laser light is to be emitted and configured to receive, as the light emitted from the light-emitting part, leaked light of the laser light emitted from the light-emitting part.

3. The laser light control device according to claim 1, wherein the light emission control section further performs a control (iii) to make the light-emitting part emit the laser light based on the image signal, performs the control (i) in a period A before and after a timing with which the reflecting surface of the polyhedron is supposed to be perpendicular to the laser light from the light-emitting part, performs the control (ii) in a period B other than the period A, and performs the control (iii) in a period C after the period A and the period B.

4. An image forming apparatus comprising:

a light-emitting part configured to emit laser light based on an image signal;

a rotating polyhedron having a plurality of reflecting surfaces capable of reflecting the laser light emitted from the light-emitting part to allow the reflected laser light to scan across a surface of a photosensitive drum;

a light-receiving part disposed, along with the light-emitting part, at a location capable of receiving the laser light reflected from the rotating polyhedron and configured to receive the light emitted from the light-emitting part and the reflected light;

a comparison circuit configured to compare the voltage output from the light-receiving part with a reference voltage equal to an output voltage of the light-receiving part in which the light receiving part receives a reference amount of light from the light-emitting part, and output an output signal when the voltage output from the light-receiving part is larger than the reference voltage, and a light emission control section configured to control driving of the light-emitting part and perform a control (i) to maintain the reference amount of light of the light-emitting part at a constant amount and a control (ii) to generate a light emission start timing with which the light-emitting part starts to emit the laser light based on the image signal, both the controls using a single voltage output from the light-receiving part depending upon an amount of light received by the light-receiving part, wherein in the control (i) the reference amount of light of the light-emitting part is maintained at the constant amount by feedback control based on the voltage output from the light-receiving part and in the control (ii) a timing with which the output signal output from the comparison circuit is received is the light emission start timing with which the light-emitting part starts to emit the laser light based on the image signal; and an image forming section configured to generate a toner image using an electrostatic latent image formed on the surface of the photosensitive drum by the laser light reflected on the rotating polyhedron and transfer the toner image directly or indirectly to a recording medium to form an image.

* * * * *